US006076504A

United States Patent [19]

Stavnheim et al.

[11] Patent Number: 6,076,504

[45] Date of Patent: Jun. 20, 2000

[54] APPARATUS FOR DIAGNOSING FAILURES AND FAULT CONDITIONS IN A FUEL SYSTEM OF AN INTERNAL COMBUSTION ENGINE

[75] Inventors: Jonathan A. Stavnheim, Columbus; Stephen West, Greenwood; Shyamala Raghunathan, Columbus, all of Ind.

[73] Assignee: Cummins Engine Company, Inc., Columbus, Ind.

[21] Appl. No.: 09/033,379

[22] Filed: Mar. 2, 1998

[51] Int. Cl.[7] ..... F02M 7/00

[52] U.S. Cl. ..... 123/447; 123/479; 123/198 D

[58] Field of Search ..... 123/447, 446, 123/494, 456, 514, 450; 73/119 A

[56] References Cited

U.S. PATENT DOCUMENTS

| | | | |
|---|---|---|---|
| 4,499,876 | 2/1985 | Yamamoto . | |
| 4,653,454 | 3/1987 | Konishi et al. . | |
| 4,730,586 | 3/1988 | Yamaguchi et al. . | |
| 4,840,060 | 6/1989 | Notz et al. . | |
| 4,899,713 | 2/1990 | Nakamura . | |
| 5,176,120 | 1/1993 | Takahashi . | |
| 5,191,867 | 3/1993 | Glassey . | |
| 5,235,954 | 8/1993 | Sverdlin . | |
| 5,311,850 | 5/1994 | Martin . | |
| 5,313,924 | 5/1994 | Regueiro . | |
| 5,408,970 | 4/1995 | Burkhard et al. . | |
| 5,417,194 | 5/1995 | Augustin | 123/479 |
| 5,445,019 | 8/1995 | Glidewell et al. . | |
| 5,471,959 | 12/1995 | Sturman . | |
| 5,477,833 | 12/1995 | Leighton . | |
| 5,484,820 | 1/1996 | Iwaszkiewicz . | |
| 5,492,099 | 2/1996 | Maddock . | |
| 5,493,902 | 2/1996 | Glidewell et al. . | |
| 5,499,538 | 3/1996 | Glidewell | 123/479 |
| 5,558,067 | 9/1996 | Blizard et al. . | |
| 5,586,538 | 12/1996 | Barnes . | |
| 5,615,656 | 4/1997 | Mathis . | |
| 5,633,458 | 5/1997 | Pauli et al. . | |
| 5,634,448 | 6/1997 | Shinogle et al. . | |
| 5,642,716 | 7/1997 | Ricco . | |
| 5,663,881 | 9/1997 | Cook, Jr. . | |
| 5,678,521 | 10/1997 | Thompson et al. . | |
| 5,681,991 | 10/1997 | Hatfield et al. . | |
| 5,686,268 | 11/1997 | Wakemen . | |
| 5,697,343 | 12/1997 | Isozumi et al. . | |
| 5,893,352 | 4/1999 | Fujiwara | 123/479 |
| 5,918,578 | 7/1999 | Oda | 123/479 |

*Primary Examiner*—Carl S. Miller
*Attorney, Agent, or Firm*—Baker & Daniels

[57] ABSTRACT

A fuel system includes a pair of electronically controllable high pressure fuel pumps operable to supply high pressure fuel from a lower pressure fuel source to a high pressure fuel collection chamber having a pressure sensor associated therewith. The fuel collection chamber feeds an electronically controllable valve operable to dispense the high pressure fuel to a fuel distribution unit supplying fuel to a number of fuel injectors. A control computer is provided for controlling the high pressure fuel pump and valve in response to requested fueling, engine speed and fuel pressure provided by the pressure sensor. The accumulator pressure profile is processed in accordance with various techniques forming part of the present invention for diagnosing pressure sensor in-range failures, fuel pump injector valve blow shut failures and failure of one of the fuel pumps. In accordance with another aspect of the present invention, the current fuel pump command signal is compared with a predicted fuel pump command stored in said computer for diagnosing overpumping conditions. The predicted fuel pump command is preferably retrieved from a look up table as a function of engine speed, commanded fuel, and accumulator pressure.

41 Claims, 13 Drawing Sheets

NORMAL PUMPING/INJECTION EVENTS
ICV COMMANDS
CYLINDER TDC POSITION
CRANK ANGLE (°)
FRONT CAM
FRONT PUMP COMMANDS
REAR CAM
REAR PUMP COMMANDS 2
4
1
5
3
6
-240
-180
-120
-60
0
60
120
180
240
300
360
420
A
B
C
D
E
F

EXPECTED PUMP COMMAND VALUES FOR
ONE ENGINE SPEED RANGE ($ES_1 < ES < ES_2$)

280

| AP | 5000 | 6000 | 9000 | 12000 | 15000 | 18000 |
|---|---|---|---|---|---|---|
| FC | | | | | | |
| -0.5 | 25 | 25 | 27 | 30 | 33 | 36 |
| 0 | 30 | 33 | 35 | 36 | 42 | 45 |
| 0.5 | 31 | 33 | 38 | 43 | 53 | 60 |
| 1 | 36 | 37 | 45 | 54 | 65 | 75 |
| 1.5 | 37 | 41 | 50 | 61 | 76 | 90 |
| 2 | 38 | 43 | 54 | 67 | 86 | 105 |
| 2.5 | 39 | 44 | 55 | 68 | 99 | 120 |
| 3 | 42 | 46 | 57 | 72 | 113 | 120 |

FIG. 12

APPARATUS FOR DIAGNOSING FAILURES AND FAULT CONDITIONS IN A FUEL SYSTEM OF AN INTERNAL COMBUSTION ENGINE

FIELD OF THE INVENTION

The present invention relates generally to fuel system control techniques, and more specifically to techniques for diagnosing failures and fault conditions in a fuel system.

BACKGROUND OF THE INVENTION

Electronically controlled high pressure fuel systems are known and commonly used in the automotive and heavy duty truck industries. Such systems may include a fuel pump operable to provide high pressure fuel to a collection unit that supplies the pressurized fuel to one or more fuel injectors. One or more pressure sensors are typically provided for monitoring and controlling the fuel pressure throughout the system.

An example of one such system is described in U.S. Pat. No. 5,678,521 to Thompson et al., which is assigned to the assignee of the present invention. The Thompson et al. fuel system includes a pair of cam driven high pressure fuel pumps operable to pump fuel from a low pressure fuel source to an accumulator. The accumulator passes the high pressure fuel to a single injection control valve which is electronically controllable to supply the fuel to a distributor unit. The distributor, in turn, distributes the fuel to any of a number of fuel injectors. The accumulator includes a pressure sensor for monitoring accumulator pressure. An electronic control unit monitors accumulator pressure, throttle position and engine speed, and is operable to control the operation of the fuel system in accordance therewith.

High pressure fuel systems of the type just described, while having many advantages over prior mechanical systems, have certain drawbacks associated therewith. For example, failure of electrical and/or mechanical components of the system may result in total system failure, in which case the engine is often shut down leaving the vehicle and occupant stranded. In severe cases, failure of such components can lead to catastrophic destruction of fuel system components.

What is therefore needed is a system for diagnosing faults and failures in an electronically controlled fuel system of the type just described. Such a system should ideally log fault codes indicative of fuel system related failures to assist in repair efforts, and should additionally provide for one or more limp home fueling operational modes so that the vehicle can be driven out of danger and/or to a repair facility.

SUMMARY OF THE INVENTION

The foregoing shortcomings of the prior art are addressed by the present invention. In accordance with one aspect of the present invention, an apparatus for diagnosing a fuel system of an internal combustion engine, comprises a first fuel pump responsive to a pump command signal for supplying high pressure fuel from a lower pressure fuel source, an accumulator receiving the high pressure fuel from the first fuel pump, a valve responsive to a valve control signal for drawing high pressure fuel from the accumulator, means for sensing fuel pressure within the accumulator and producing a pressure signal corresponding thereto, wherein the pressure signal has peak values corresponding to peak pressures of fuel supplied thereto by the first fuel pump and lower valley values corresponding to valley pressures of fuel within the accumulator resulting from fuel drawn therefrom. A control computer is provided for sampling a number of first pressure values each near a separate one of the peak values and a number of second pressure values each near a separate one of the valley values of the pressure signal, and determining an average pressure value based thereon. The control computer is operable to compare each of the number of first and second pressure values to the average pressure value and increment an error counter if at least one of the number of first and second pressure values are outside of a threshold range of the average pressure value.

In accordance with another aspect of the present invention, a method of diagnosing a fuel system of an internal combustion engine comprises the steps of activating a first fuel pump to supply fuel from a fuel source to an accumulator based on a target fuel pressure value, measuring a first pressure value within the accumulator near an actual peak pressure value therein resulting from activation of the first fuel pump, activating a control valve to draw pressurized fuel from the accumulator resulting from activation of the first fuel pump, the accumulator thereafter defining a valley fuel pressure therein, measuring a second pressure value within the accumulator near the valley fuel pressure, determining an average pressure value based on a number of the first and second pressure values, comparing each of the number of first and second pressure values with the average pressure value, and incrementing an error counter if at least one of the number of first and second pressure values are outside of a threshold range of the average pressure value.

In accordance with a further aspect of the present invention, an apparatus for diagnosing a fuel system of an internal combustion engine comprises a first fuel pump responsive to first pump command signals for supplying high pressure fuel from a lower pressure fuel source, an accumulator receiving the high pressure fuel from the first fuel pump, means for sensing fuel pressure within the accumulator and producing a pressure signal corresponding thereto, and a control computer receiving the pressure signal and producing the first pump control signals, the control computer producing a number of first pump command signals corresponding to zero commanded fueling and monitoring first corresponding changes in the pressure signal, the control computer incrementing an error counter if at least one of the first corresponding changes in the pressure signal exceeds a predefined pressure change threshold.

In accordance with yet another aspect of the present invention, a method of diagnosing a fuel system of an internal combustion engine comprises the steps of activating a first fuel pump to supply zero commanded fuel from a fuel source to an accumulator, measuring a first corresponding change in pressure in the accumulator resulting from activation of the first fuel pump with zero commanded fuel, repeating the activating and measuring steps a number of times, comparing each of the number of first corresponding changes in pressure with a pressure change threshold, and incrementing an error counter if at least one of the number of first corresponding changes in pressure exceeds a pressure change threshold.

In accordance with still a further aspect of the present invention, an apparatus for diagnosing a fuel system of an internal combustion engine comprises a first fuel pump responsive to first pump command signals for supplying high pressure fuel from a lower pressure fuel source, a second fuel pump responsive to second pump command signals for supplying high pressure fuel from the lower pressure fuel source, an accumulator receiving the high pressure fuel from the first and second fuel pumps, means for sensing fuel pressure within the accumulator and producing a pressure signal corresponding thereto, and a control computer producing a number of the first and second pump command signals and monitoring first and second corresponding changes in the pressure signal, the control computer determining first and second average pressure change values based on respective ones of the number of first and second corresponding changes in the pressure signal, the control computer incrementing an error counter if a difference between the first and second average pressure change values is one of greater than a first pressure change limit and less than a second pressure change limit.

In accordance with still another aspect of the present invention, a method of diagnosing a fuel system of an internal combustion engine comprises the steps of activating a first fuel pump to supply fuel to an accumulator based on a target fuel pressure value, activating a second fuel pump to supply fuel to the accumulator based on the target fuel pressure value, determining a first pressure change value corresponding to a change in fuel pressure within the accumulator resulting from activation of the first pump, determining a second pressure change value corresponding to a change in fuel pressure within the accumulator resulting from activation of the second pump, repeating the activation steps and the determining steps a number of times, computing a first average pressure change value as an average of the number of first pressure change values, computing a second average pressure change value as an average of the number of second pressure change values, and incrementing an error counter if a difference between the first and second average pressure change values is one of greater than a first pressure change limit and less than a second pressure change limit.

In accordance with yet another aspect of the present invention, an apparatus for diagnosing a fuel system of an internal combustion engine comprises a fuel pump responsive to a pump command signal for supplying high pressure fuel from a lower pressure fuel source, an accumulator receiving the high pressure fuel from the fuel pump, means for producing a fuel demand signal, means for sensing fuel pressure within the accumulator and producing a pressure signal corresponding thereto, means for sensing engine speed and producing an engine speed signal corresponding thereto, and a control computer receiving the pressure, engine speed and fuel demand signals and producing the pump command signal, the control computer operable to determine a fuel command based on the engine speed and fuel demand signals, the control computer determining a predicted pump command based on current values of the pressure signal, the engine speed signal and the fuel command, the control computer logging a fault code if a difference between a current value of the pump command signal and the predicted pump command is greater than a threshold level.

In accordance with yet a further aspect of the present invention, a method of diagnosing a fuel system of an internal combustion engine comprising the steps of sensing a fuel demand signal, sensing an engine speed signal, sensing a pressure signal indicative of fuel pressure within an accumulator forming a portion of a fuel system, determining a fuel command based on the fuel demand and engine speed signals, determining a fuel pump command based on the fuel demand and pressure signals, the pump command activating a fuel pump to supply fuel to the accumulator, determining a predicted fuel pump command based on current values of the engine speed signal, the pressure signal and the fuel command, and logging a fault code if a difference between a current value of the pump command and the predicted pump command is greater than a threshold value.

One object of the present invention is to provide a system for diagnosing failure conditions in an electronically controlled fuel system.

Another object of the present invention is to provide such a system for diagnosing in-range pressure sensor failures.

A further object of the present invention is to provide such a system for diagnosing fuel pump injector blow shut failures.

Yet another object of the present invention is to provide such a system for diagnosing failure of one fuel pump in a dual pump fuel system.

Still another object of the present invention is to provide such a system for diagnosing overpumping of high pressure fuel to the electronically controlled fuel system.

These and other objects of the present invention will become more apparent from the following description of the preferred embodiment.

BRIEF DESCRIPTION OF THE DRAWINGS

FIG. 12 is a table illustrating one portion of a preferred look up table for use in diagnosing overpumping of fuel in the fuel system of FIG. 1.

DESCRIPTION OF THE PREFERRED EMBODIMENT

Figure 1:
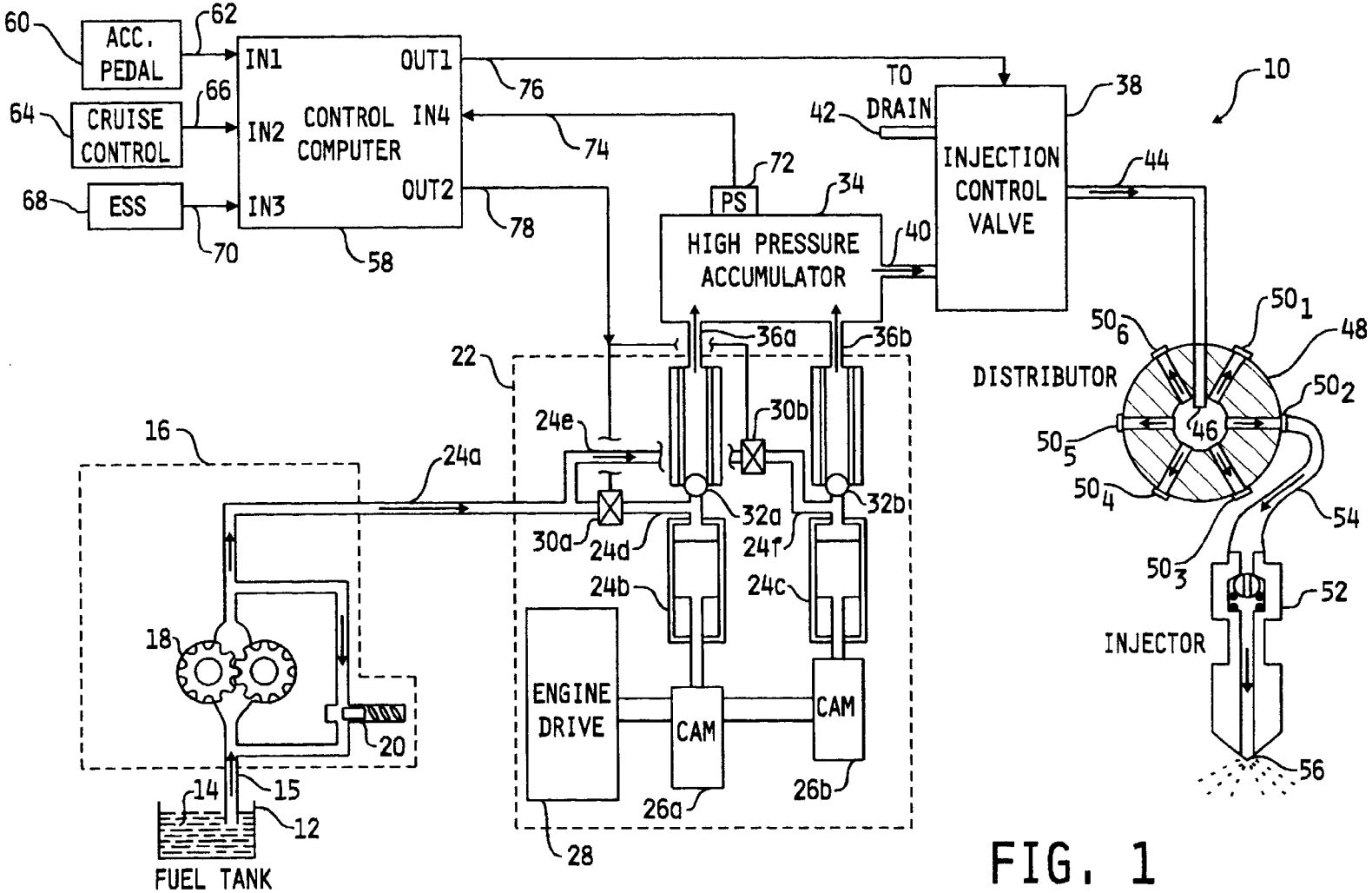
FIG. 1 is a diagrammatic illustration of a fuel system for an internal combustion engine and associated control system, in accordance with the present invention.

For the purposes of promoting an understanding of the principles of the invention, reference will now be made to one preferred embodiment illustrated in the drawings and specific language will be used to describe the same. It will nevertheless be understood that no limitation of the scope of the invention is thereby intended, such alterations and further modifications in the illustrated embodiment, and such further applications of the principles of the invention as illustrated therein being contemplated as would normally occur to one skilled in the art to which the invention relates.

Referring now to FIG. 1, a fuel system and associated control system 10, in accordance with the present invention, is shown. System 10 includes a fuel tank 12 or similar source of fuel 14 having a fuel flow path 15 extending into a low pressure fuel pump 16. Preferably, low pressure pump 16 is a known gear pump having a manually gear mechanism 18 and fuel pressure regulator 20. A fuel flow conduit 24*a* extends into a high pressure fuel pump 22 having a first (front) pump element 24*b* and a second (rear) pump element 24*c*. Pump elements 24*b* and 24*c* are mechanically driven by an engine drive mechanism 28 via cams 26*a* and 26*b* respectively. Fuel flow conduit 24*a* feeds a first pump control valve 30*a* having an output fuel flow conduit 24*d* connected to pump element 24*b*. Fuel flow conduit 24*a* is also connected to a fuel flow conduit 24*e* which feeds a second pump control valve 30*b* having an output fuel flow conduit 24*f* connected to pump element 24*c*. The first pump element 24*b* is connected to a high pressure fuel accumulator 34 via conduit 36*a* with a check valve 32*a* disposed therebetween. Likewise, the second pump element 24*c* is connected to accumulator 34 via conduit 36*b* with a check valve 32*b* disposed therebetween.

High pressure accumulator 34 is connected to an injection control valve 38 via conduit 40. Injection control valve 38 includes a drain conduit 42 and an output conduit 44 feeding an input 46 of a fuel distributor 48. Distributor 48 includes a number of output ports, wherein six such output ports $\mathbf{50}_1$–$\mathbf{50}_6$ are illustrated in FIG. 1. It is to be understood, however, that distributor 48 may include any number of output ports for distributing fuel to a number of fuel injectors or groups of fuel injectors. In FIG. 1, one such fuel injector 52 is connected to output port 502 via fuel flow path 54, wherein injector 52 has an injector output 56 for injecting fuel into an engine cylinder.

System 10 is electronically controlled by a control computer 58 in response to a number of sensor and engine/vehicle operating conditions. An accelerator pedal 60 preferably includes an accelerator pedal position sensor (not shown) providing a signal indicative of accelerator pedal position or percentage to input IN1 of control computer 58 via signal path 62, although the present invention contemplates utilizing any known sensing mechanism to provide control computer 58 with a fuel demand signal from accelerator pedal 60. A known cruise control unit 64 provides a fuel demand signal to input IN2 of control computer 58 via signal path 66 indicative of desired vehicle speed when cruise control operation is selected as is known in the art.

An engine speed sensor 68 is connected to an input IN3 of control computer 58 via signal path 70, providing control computer 58 with a signal indicative of engine speed position. In one embodiment, engine speed sensor 68 is a known HALL effect sensor, although the present invention contemplates using any known sensor operable to sense engine speed and preferably engine position, such as a variable reluctance sensor. High pressure accumulator 34 includes a pressure sensor 72 connected thereto which is operable to sense pressure within the accumulator 34. Pressure sensor 72 provides a pressure signal indicative of accumulator pressure to input IN4 of control computer 58 via signal path 74. Preferably, pressure sensor 72 is a known combination pressure sensor and fuel temperature sensor, although the present invention contemplates utilizing any known device, mechanism or technique for providing control computer 58 with a signal indicative of fuel pressure within accumulator 34, conduit 36*a*, conduit 36*b* or conduit 40, and any known device, mechanism or technique for providing control computer 58 with a signal indicative of fuel temperature within accumulator 34, conduit 36*a*, conduit 36*b* or conduit 40. Pressure/temperature sensor 72 is thus operable to provide control computer 58 with a signal indicative of fuel pressure and fuel temperature within the accumulator 34, although the present invention contemplates providing separate sensors for providing control computer 58 with fuel pressure and fuel temperature information. Control computer 58 also includes a first output OUT1 connected to injection control valve 38 via signal path 76 and a second output 78 connected to pump control valves 30*a* and 30*b* via signal path 78. The general operation of fuel system 10 and associated control system will be described with reference to FIGS. 1–4.

Figure 2:
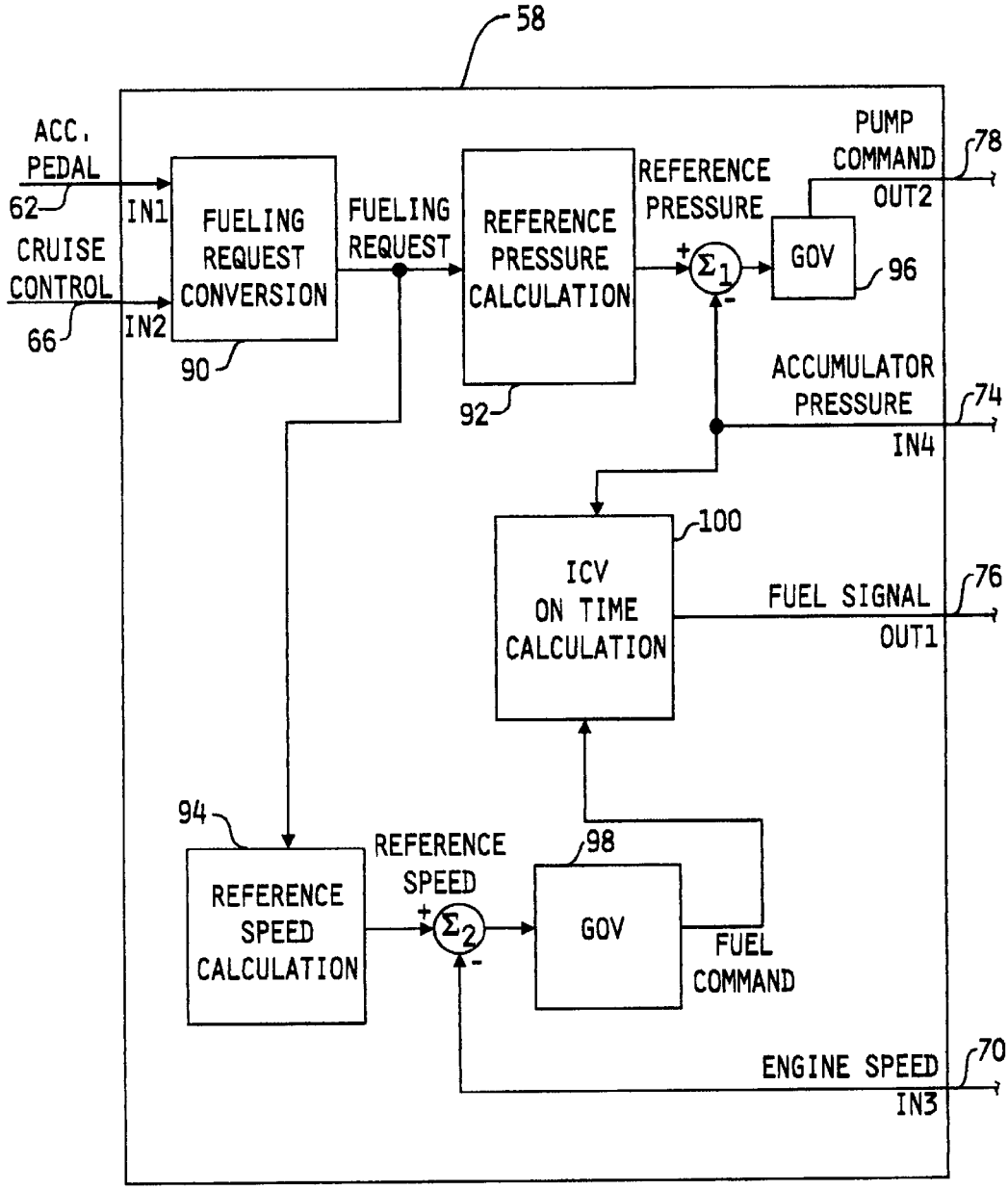
FIG. 2 is a block diagram illustration of some of the internal features of the control computer of FIG. 1 under normal operation thereof, as they relate to the present invention.

Referring to FIGS. 1 and 2, some of the internal features of control computer 58, as they relate to the present invention, are illustrated. The accelerator pedal signal and cruise control signal enter control computer 58 via signal paths 62 and 66 respectively. As is known in the art, both signals are operator originated in accordance with desired fueling, and control computer 58 is responsive to either signal to correspondingly control the fuel system 10. Hereinafter, the accelerator pedal and/or cruise control signal will be referred to generically as a fuel demand signal. In any case, the fuel demand signal is provided to a fueling request conversion block 90 which converts the fuel demand signal to a fueling request signal in accordance with known techniques. Typically, fueling request conversion block 90 includes a number of fuel maps and is responsive to a number of engine/vehicle operating conditions, in addition to the fuel demand signal, to determine an appropriate fueling request value.

The fueling request value is provided to a reference pressure calculation block 92 which is responsive to the fueling request value to determine a reference pressure indicative of a desired accumulator pressure set point. The reference pressure is provided to an accumulator pressure control loop which provides a pump command signal on signal path 78 based on the reference pressure value and accumulator pressure provided by pressure sensor 72 on signal path 74. In one embodiment, the reference pressure value is provided to a positive input of a summing node $\Sigma_1$ which also has a negative input connected to signal path 74. An output of summing node $\Sigma_1$ is provided to a governor block 96, the output of which is connected to signal path 78. In one embodiment, governor block 96 includes a known PID governor, although the present invention contemplates utilizing other known governors or governor techniques.

The fueling request value is also provided to a reference speed calculation block 94 which is responsive to the fueling request value to determine a reference speed indicative of a desired engine speed. The reference speed is provided to an engine speed control loop which produces a fuel command value in accordance therewith, as is known in the art, based on the reference speed and actual engine speed provided by engine speed sensor 68 on signal path 70. In one embodiment, the reference speed value is provided to a positive input of a summing node $\Sigma_2$ which also has a negative input connected to signal path 70. An output of summing node $\Sigma_2$ is provided to a governor block 98, the output of which provides the fuel command value. In one embodiment, governor block 98 includes a known PID governor, although the present invention contemplates utilizing other known governors or governor techniques.

Control computer 58 also includes an ICV on time calculation block 100 which is operable to determine an "on time" for activating the injection control valve (ICV) 38 based on the actual accumulator pressure signal provided on signal path 74 and the fuel command provided by governor 98. The ICV on time calculation block 100 produces a fuel signal on signal path 76 for controlling activation/deactivation of the injector control valve 38.

Figures 3A, 3B, 3C, 3D, 3E, 3F, 3G:
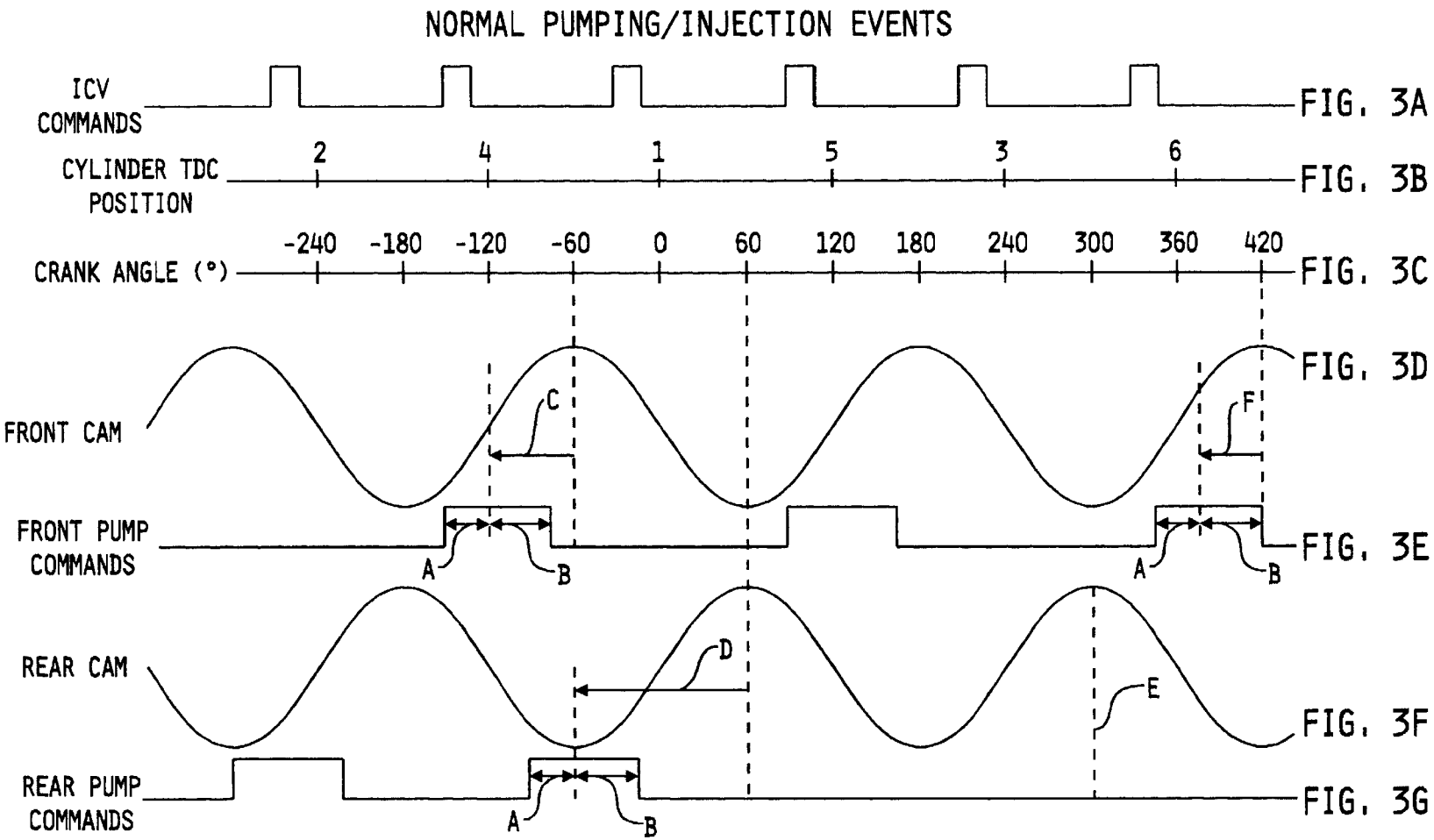
FIG. 3 is composed of FIGS. 3A–3G and illustrates waveform diagrams of normal operation of the fuel system and associated control system of FIG. 1.

Referring now to FIG. 3, which is composed of FIGS. 3A–3G, some of the general timing events of fuel system 10 are illustrated. Control computer 58 is operable to control fuel pressure within the accumulator 34 by controlling the pump control valves 24*b* and 24*c*. Control of one of the valves 24*b* will now be described, although it is to be understood that operation thereof applies identically to valve 24*c*. As the pump plunger retract within the pump element 24*b* under the action of cam 26*a*, fuel supplied by low pressure fuel pump 16 flows into the trapped volume of fuel pump element 24*b* as long as valve 30*a* is not energized. If valve 30*a* remains de-energized as the pump plunger rises, fuel within the trapped volume flows back out to low pressure fuel pump 16. When the pump control valve 30*a* is energized, the outward fuel flow path is closed and the fuel within the trapped volume of pump element 24*b* becomes pressurized as the pump plunger rises. When the fuel pressure within the trapped volume reaches a specified pressure level, check valve 32*a* opens and the pressurized fuel within the trapped volume flows into the accumulator. Based upon a difference between the reference pressure (block 92 of FIG. 2) and the actual accumulator pressure (provided on signal path 74), the pressure control loop of FIG. 2 specifies the angle before pump plunger top dead center (TDC) at which the pump control valve 30*a* is energized. This angle will be referred to hereinafter as a valve close angle (VCA).

In one embodiment of fuel system 10, as illustrated in FIGS. 3B–3G, pump plunger TDC (shown in FIGS. 3D and 3F as front and rear cam respectively) and cylinder TDC (FIG. 3B) are aligned 60 crank degrees apart (FIG. 3C). The commanded VCA (pump command) may occur anywhere between zero and 120 degrees before pump plunger TDC (see FIGS. 3D–3G). When the difference between the reference pressure and actual accumulator pressure is large, the respective commanded VCA is large and vice versa. Examples of different commanded VCA's are illustrated in FIGS. 3E and 3G wherein pump command activation times are shown as having a pump activation delay time A and a pump activation time B. VCA's corresponding to 65 degrees and 30 degrees are shown in FIG. 3E by C and F respectively, and a VCA of 120 degrees is shown in FIG. 3G by D. If the actual accumulator pressure is greater than the reference pressure, the commanded VCA is automatically set at zero degrees, corresponding to no energization of the pump control valve 30*a*, as illustrated at E in FIG. 3G. Control computer 58 is further operable to activate the injection control valve 38 (to control fuel timing) and deactivate valve 38 (to control fueling amount) between pump plunger TDC and cylinder TDC as illustrated in FIGS. 3A, 3B, 3D and 3F. Further operational and structural details of fuel system 10 and associated control system are given in U.S. Pat. No. 5,678,521 to Thompson et al., which is assigned to the assignee of the present invention, the contents of which are incorporated herein by reference.

Figure 4:
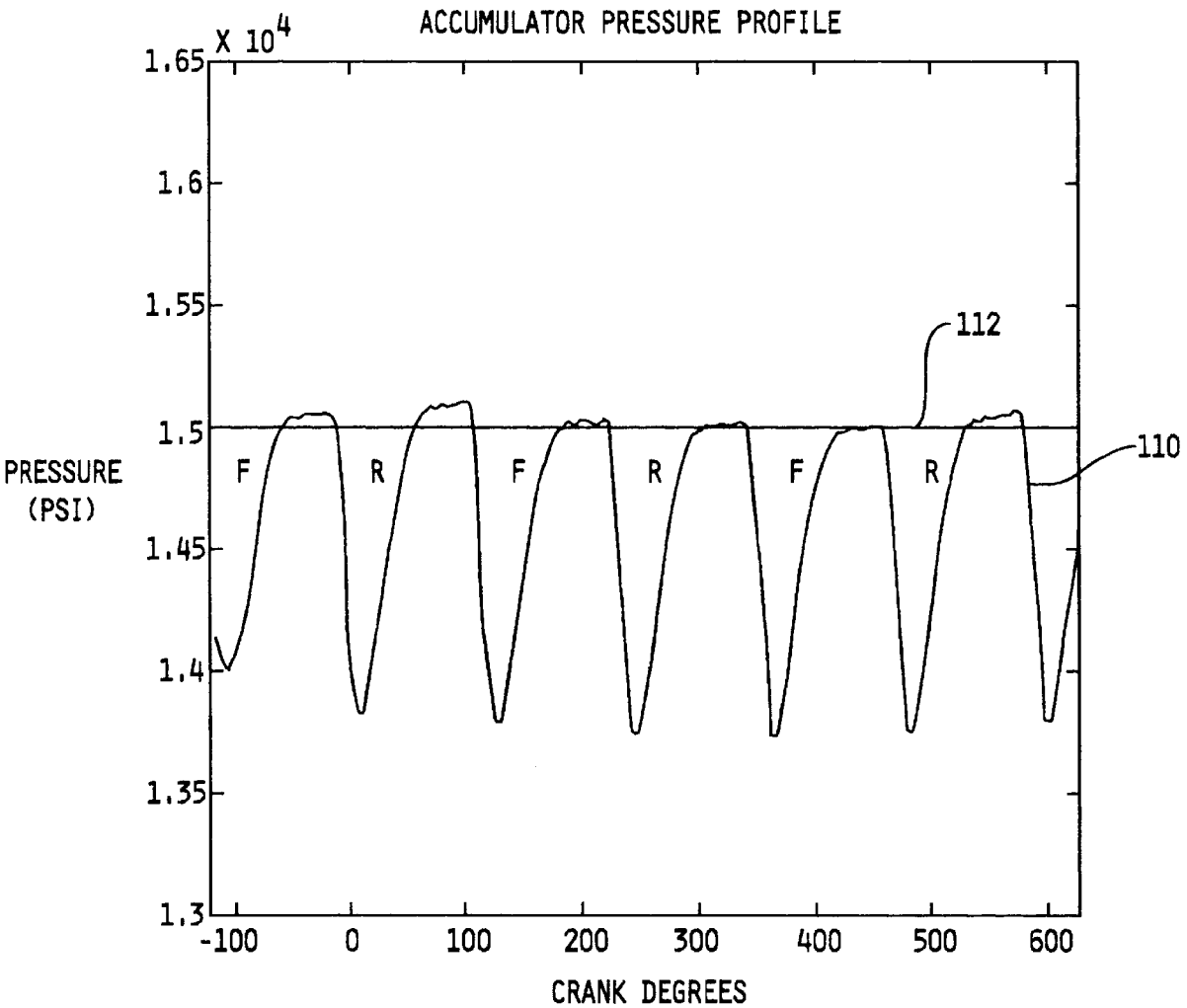
FIG. 4 is a plot of a normal pressure waveform associated with the accumulator of in FIG. 1.

As fuel enters the accumulator 34, accumulator pressure begins to rise and reaches the reference pressure (FIG. 2) approximately 30 degrees after pump plunger TDC. Thirty degrees after pump plunger TDC of each pumping event, control computer 58 samples accumulator pressure and maintains such samples as peak accumulator pressure samples. Approximately 45–75 degrees after pump plunger TDC, control computer 58 activates the injection control valve 38 (FIG. 3A) to begin an injection event. As fuel is drawn out of the accumulator 38 resulting from activation of the injection control valve 38, the pressure in the accumulator decreases, and approximately 80 degrees after pump plunger TDC accumulator pressure reaches a minimum. Control computer 58 again samples accumulator pressure at 80 degrees after pump plunger TDC and maintains such samples valley accumulator pressure samples. A plot of accumulator pressure 110 vs crank degrees, as contrasted with reference pressure 112, is illustrated in FIG. 4. FIG. 4 illustrates an accumulator pressure profile for one complete cam revolution of a six cylinder engine. As shown by waveform 110, the front (24*b*) and rear (24*c*) pump elements alternate operation, and control computer 58 samples six peak pressure values and six valley pressure values each cam revolution.

In accordance with one aspect of the present invention, control computer 58 is operable to monitor the accumulator pressure waveform, an example of which is illustrated in FIG. 4, and diagnose various fuel system related faults and failure conditions. One example of such a fuel system fault or failure condition is a stuck in-range failure of pressure sensor 72. Control computer 58 is operable to detect such a failure condition by monitoring accumulator pressure via signal path 74 and processing this signal for expected pressure changes. If the accumulator pressure changes less than expected, control computer 58 logs a fault code therein, and executes a limp home fueling algorithm directed at pressure sensor-related failures.

Figure 5:
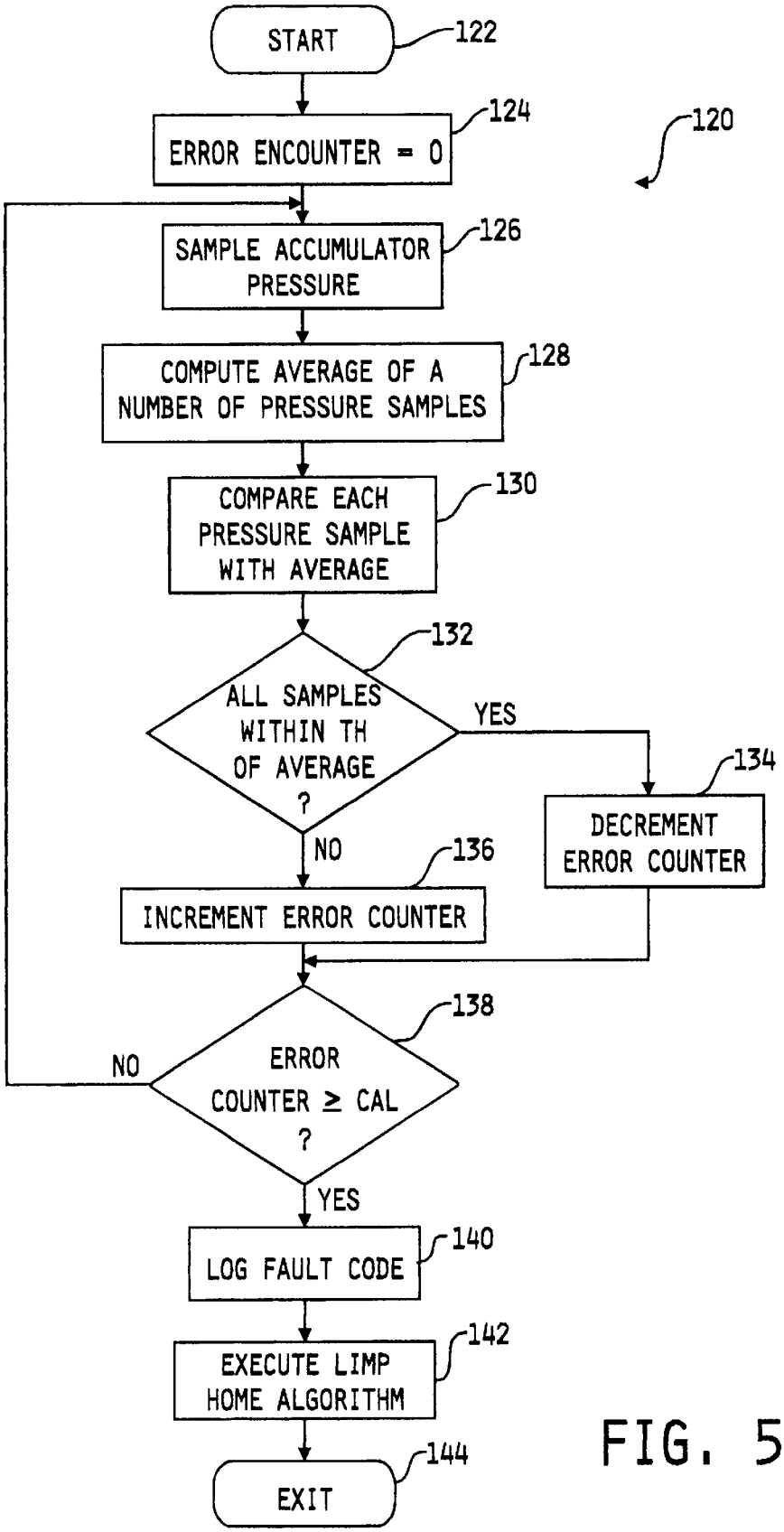
FIG. 5 is a flowchart illustrating one preferred embodiment of a software algorithm for diagnosing the waveform of FIG. 4 for in-range pressure sensor failures.

Referring now to FIG. 5, one preferred embodiment of a software algorithm 120 for diagnosing a stuck in-range failure condition of pressure sensor 72 is shown. Control computer 58 preferably has algorithm 120 stored therein and is operable to execute algorithm 120 many times per second as is known in the art. The algorithm begins at step 122 and at step 124, an error counter is set to an arbitrary value; zero in this case. Thereafter at step 126, control computer 58 samples the accumulator pressure signal provided on signal path 74. In the fuel system embodiment illustrated and described hereinabove, control computer 58 preferably samples the accumulator pressure signal as illustrated in FIG. 4; i.e. six peak pressure signals and six valley pressure signals for a six cylinder engine. It is to be understood, however, that other accumulator pressure profiles may be used wherein step 126 preferably includes at least sampling all pressure peaks and valleys. At any rate, algorithm 120 continues from step 126 at step 128.

At step 128, control computer 58 computes an average pressure value based on at least some of the accumulator pressure samples. Preferably, all twelve samples are used to compute the average pressure value, although a number of samples less than twelve may be used in this computation. In one embodiment, control computer 58 computes the average pressure value as an algebraic average of the pressure sample values, although the present invention contemplates using other averaging techniques such as, for example, root-mean-square or median determinations or other more complicated averaging techniques. In any case, algorithm execution continues from step 128 at step 130 where control computer 58 is operable to compare at least some of the accumulator pressure samples with the average pressure value, preferably in accordance with well known equations. Preferably, control computer 58 is operable in step 130 to compare each of the pressure samples (12 in the present example) with the average pressure value.

Thereafter at step 132, control computer 58 determines whether, as a result of the comparison step 130, at least one or more of the accumulator pressure samples is outside of a threshold value TH of the average pressure value. Preferably, control computer 58 executes step 132 by determining whether all of the samples are within TH of the average pressure value. If not, algorithm execution continues at step 134 where the control computer 58 decrements the error counter (preferably not below zero, however). If, at step 132, control computer 58 determines that all of the samples are within TH of the average pressure value, control computer 58 increments the error counter. From either of steps 134 or 136, algorithm execution continues at step 138. In one embodiment, TH is set at 100 psi, although the present invention contemplates using other psi values for TH.

At step 138, control computer 58 compares the error counter against a predefined (preferably calibratable) count value. If the error counter is less than the predefined count value, algorithm execution loops back to step 126. If, at step 138, control computer 58 determines that the error counter is greater than or equal to the predefined count value, algorithm execution continues at step 140 where control computer 58 logs a fault code therein indicative of a stuck in range pressure sensor failure. In one embodiment, the predefined count value is set at 36 counts, although the present invention contemplates utilizing other count values. Algorithm execution continues from step 140 at step 142 where control computer 58 is operable to execute a limp home fueling algorithm. Preferably, the limp home algorithm is directed to providing at least minimum fueling to sustain engine operation so that the vehicle may be driven out of danger and/or to a service/repair facility. One example of such a limp home algorithm is detailed in U.S. Pat. No. 5,937,826 entitled APPARATUS FOR CONTROLLING A FUEL SYSTEM OF AN INTERNAL COMBUSTION ENGINE and assigned to the assignee of the present invention, the contents of which are incorporated herein by reference. Algorithm execution continues from step 142 at step 144 where algorithm execution is returned to its calling routine. Alternatively, step 142 may loop back to step 124 for continuous execution of algorithm 120.

Figure 6:
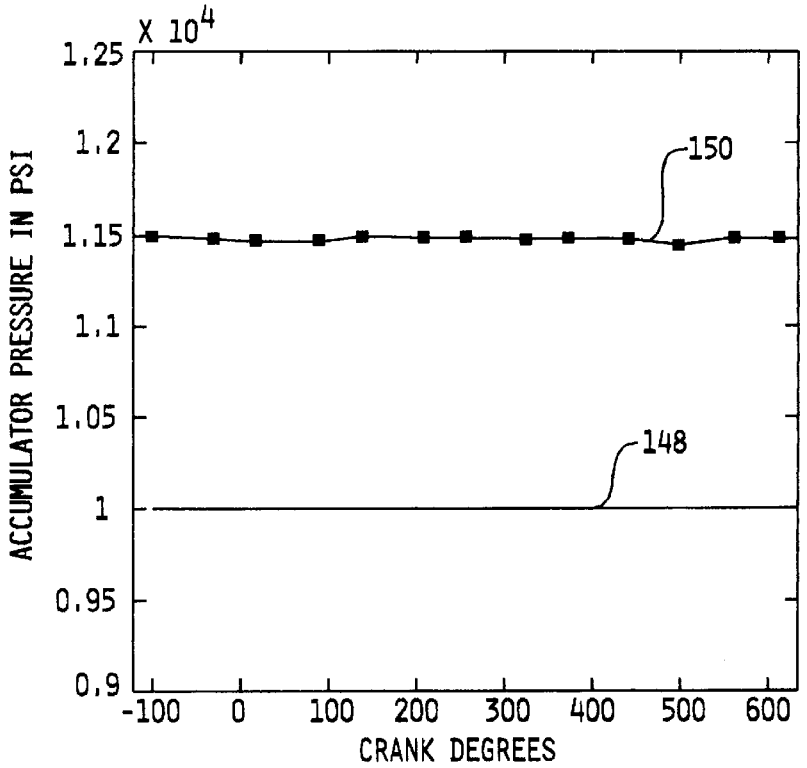
FIG. 6 is a plot of a pressure waveform associated with the accumulator of FIG. 1 illustrating an in-range pressure sensor failure condition.

Referring now to FIG. 6, an example accumulator pressure waveform 150 is shown in contrast to a reference pressure value 148, wherein waveform 150 results from a stuck in range pressure sensor 72. The average pressure value, using all twelve pressure samples, is 11,506 psi, with an average positive variation of 7.324 psi and an average negative variation of 21.973 psi. In contrast, the average pressure value of waveform 110 of FIG. 4 is 14,320.4 psi with an average positive variation of 734.86 psi and an average negative variation of 759.28 psi. It should be noted that under certain engine operating conditions the commanded VCA (pump command) and fuel signal (provided to injection control valve 38) will be near zero, and accumulator pressure will accordingly resemble a flat line over one cam revolution. To avoid false detection of a stuck in range pressure sensor failure, it is accordingly recommended that algorithm 120 should not be executed if the average injection control valve on time, wherein injection control on time is determined in block 100 of FIG. 2, is less than some low fueling threshold for the cam revolution (six injection events in this case).

Another example of a fuel system fault or failure condition that is diagnosable in accordance with the present invention is a pump command valve blow shut failure. Under certain engine fueling conditions (e.g. high crank speed, debris in the valve, etc.), the force of the fuel flowing out of the pump chamber of either pump element 24*b* or 24*c* is sufficient to mechanically close, or activate, the respective pump control valve 30*a* or 30*b*. This phenomenon is typically referred to as pump control valve blow shut. Generally, a pump control valve that has blown shut has done so at a valve position corresponding to a VCA of greater than zero degrees before pump plunger TDC. Thus, while normal operation of fuel system 10 will not be affected if the commanded VCA is greater than the VCA resulting from the blow shut condition, more fuel than is required will be pumped to the accumulator 34 if the VCA resulting from the blow shut condition is greater than the commanded VCA. As a result, fuel pressure within the accumulator will rise above the reference pressure (accumulator pressure set point), in which case control computer 58 will react by commanding zero VCA. Although zero VCA is commanded, some amount of fuel will still be pumped to the accumulator as a result of the blow shut condition. Control computer 58 is operable to detect such a failure condition by monitoring the commanded VCA provided on signal path 78 and monitoring accumulator pressure via signal path 74 and processing this signal for expected pressure changes. If the accumulator pressure changes more than expected, control computer 58 logs a fault code therein, and executes a limp home fueling algorithm directed to pump related failures.

Figure 7A:
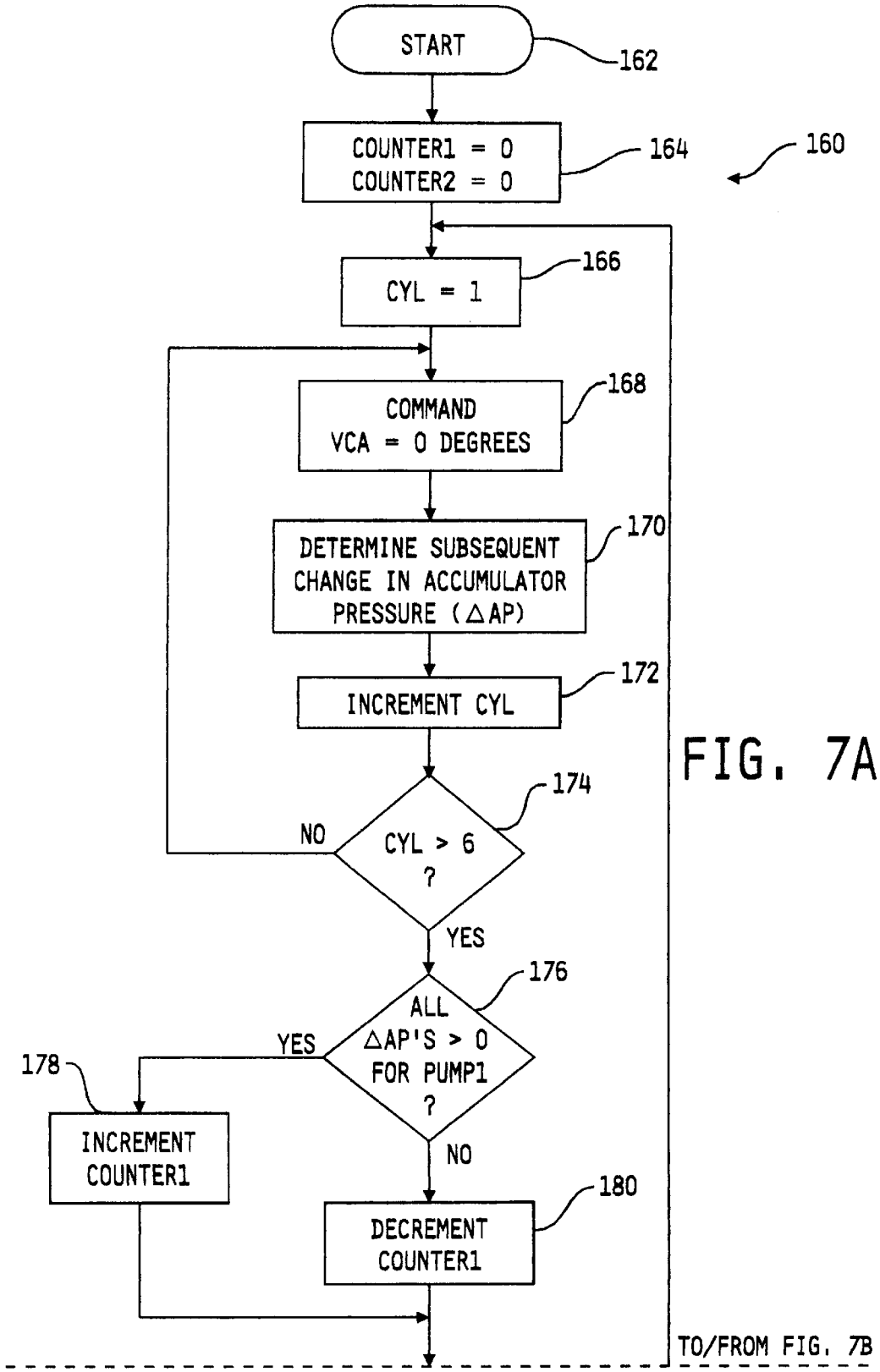
FIG. 7 is composed of FIGS. 7A and 7B is a flowchart illustrating one preferred embodiment of a software algorithm for diagnosing the waveform of FIG. 4 for a fuel pump injector control valve blow shut failure condition.
Figure 7B:
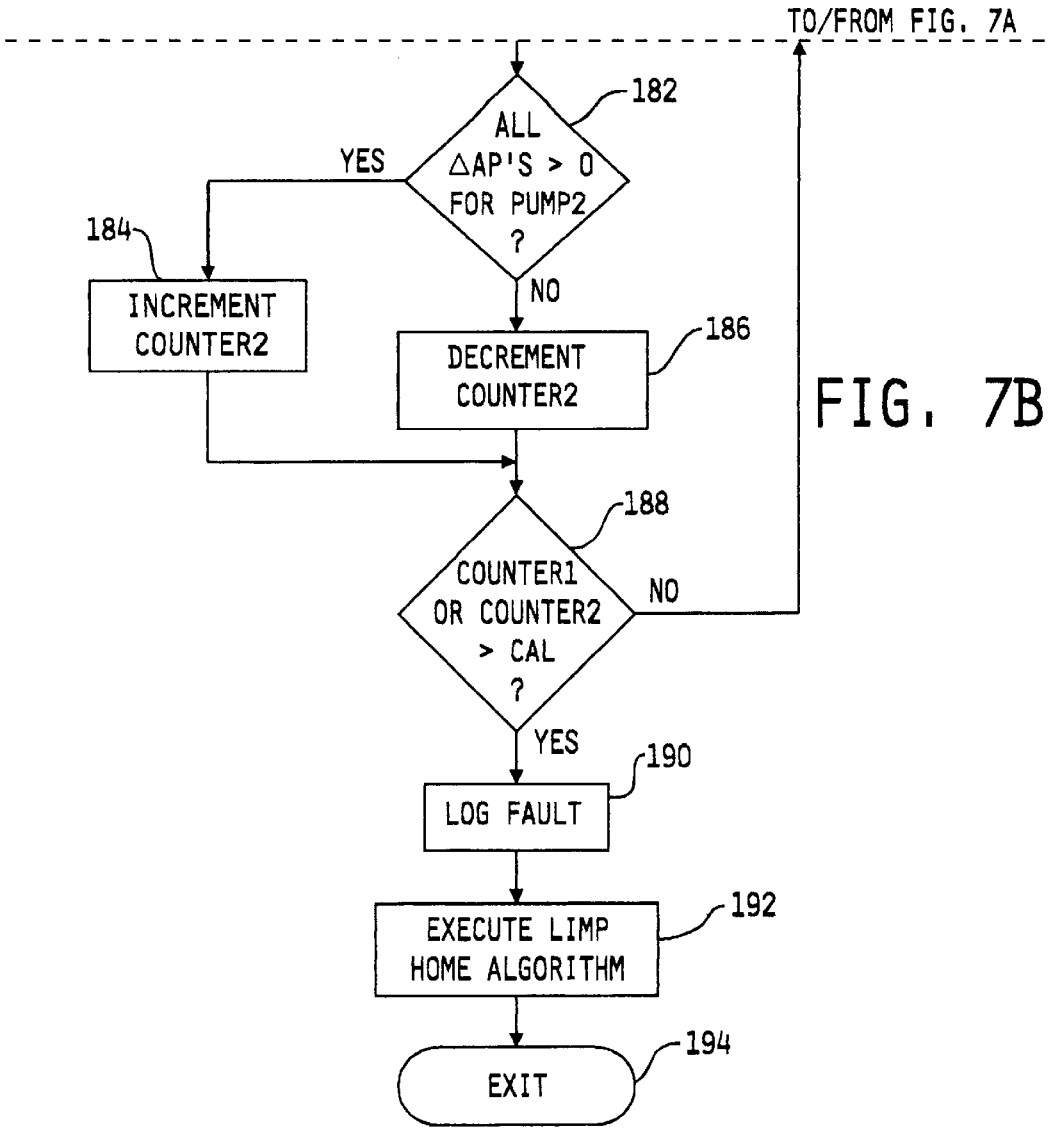

Referring now to FIG. 7, which is composed of FIGS. 7A and 7B, one preferred embodiment of a software algorithm 160 for diagnosing a blow shut failure condition associated with pump control valve 30*a* or 30*b* is shown. Control computer 58 preferably has algorithm 160 stored therein and is operable to execute algorithm 160 many times per second as is known in the art. The algorithm begins at step 162 and at step 164, control computer 58 presets first and second error counters to an arbitrary value; zero in this case. Thereafter at step 166, control computer 58 sets a loop counter, cyl, wherein cyl is equal to the number of pumping/injection events (here six), to an arbitrary value; one in this case. Thereafter at step 168, control computer 58 determines whether the commanded VCA is equal to equal to zero for at least a complete cam revolution by monitoring the fuel command output provided on signal path 78. If, at step 168, the commanded VCA is not equal to zero, algorithm execution loops back to step 164. If, at step 168, the commanded VCA is equal to zero, algorithm execution continues at step 170.

If the fuel system 10 is operating normally, a commanded VCA equal to zero should result minimal change in accumulator pressure over the cam revolution. Control computer 58 is accordingly operable at step 170 to determine a change in accumulator pressure ($\Delta AP$) due to commanding VCA equal to zero at step 168. Control computer 58 stores the $\Delta AP$ corresponding to current pumping/injection event at step 170, increments cyl at step 172 and thereafter tests cyl to determine whether all pumping/injection events have been processed. In the present example, six such pumping/injection events occur so that control computer stores six such $\Delta AP$ values. At step 172, control computer 58 thus tests cyl against the value six, and if less than or equal to six, algorithm execution loops back to step 168. If, on the other hand, control computer determines at step 174 that cyl is greater than six, algorithm execution continues at step 176.

At step 176, control computer 58 determines whether at least some of the $\Delta AP$ values are greater than some pressure change threshold TH for the first (front) fuel pump 24*b*. In one embodiment, control computer 58 is operable in step 176 to determine whether all ΔAP values are greater than TH, although the present invention contemplates testing for less than all of the ΔAP values being less than TH at step 176. In one embodiment, TH is set at 450 psi, although the present invention contemplates utilizing other values of TH. At any rate, if all ΔAP values are greater than TH at step 176, algorithm execution continues at step 178 where control computer 58 increments the first error counter. Conversely, if all ΔAP values are less than or equal to TH at step 176, algorithm execution continues at step 180 where control computer 58 decrements the first error counter (preferably not below zero). Algorithm execution continues from either of steps 178 or 180 at step 182.

At step 182, control computer 58 determines whether at least some of the ΔAP values are greater than pressure change threshold TH for the second (rear) fuel pump 24*c*. In one embodiment, control computer 58 is operable in step 182 to determine whether all ΔAP values are greater than TH, although the present invention contemplates testing for less than all of the ΔAP values being less than TH at step 182. In one embodiment, TH is set at 450 psi, although the present invention contemplates utilizing other TH values, and further contemplates using a TH value different from the TH value for the first (front) pump 24*b*. In any event, if all ΔAP values are greater than TH at step 182, algorithm execution continues at step 184 where control computer 58 increments the second error counter. Conversely, if all ΔAP values are less than or equal to TH at step 182, algorithm execution continues at step 186 where control computer 58 decrements the second error counter (preferably not below zero). Algorithm execution continues from either of steps 184 or 186 at step 188 where control computer 58 tests whether either of the first or second error counters have exceeded a predefined (preferably calibratable) count value. In one embodiment, the predefined count value is 36, although the present invention contemplates utilizing other count values. If neither of the error counters have exceeded the predefined count value, algorithm execution loops back to step 166. If, on the other hand, either of the error counters have exceeded the predefined count value, algorithm execution advances to step 190 where control computer logs a corresponding fault code and advances to step 192 where control computer 58 executes a limp home fueling algorithm. Preferably, the limp home algorithm is directed to providing at least minimum fueling to sustain engine operation so that the vehicle may be driven out of danger and/or to a service/repair facility. One example of such a limp home algorithm is detailed in U.S. Pat. No. 5,937,826 entitled APPARATUS FOR CONTROLLING A FUEL SYSTEM OF AN INTERNAL COMBUSTION ENGINE and assigned to the assignee of the present invention, the contents of which have been incorporated herein by reference. Algorithm execution continues from step 192 at step 194 where algorithm execution is returned to its calling routine. Alternatively, step 192 may loop back to step 164 for continuous execution of algorithm 160.

Figure 8:
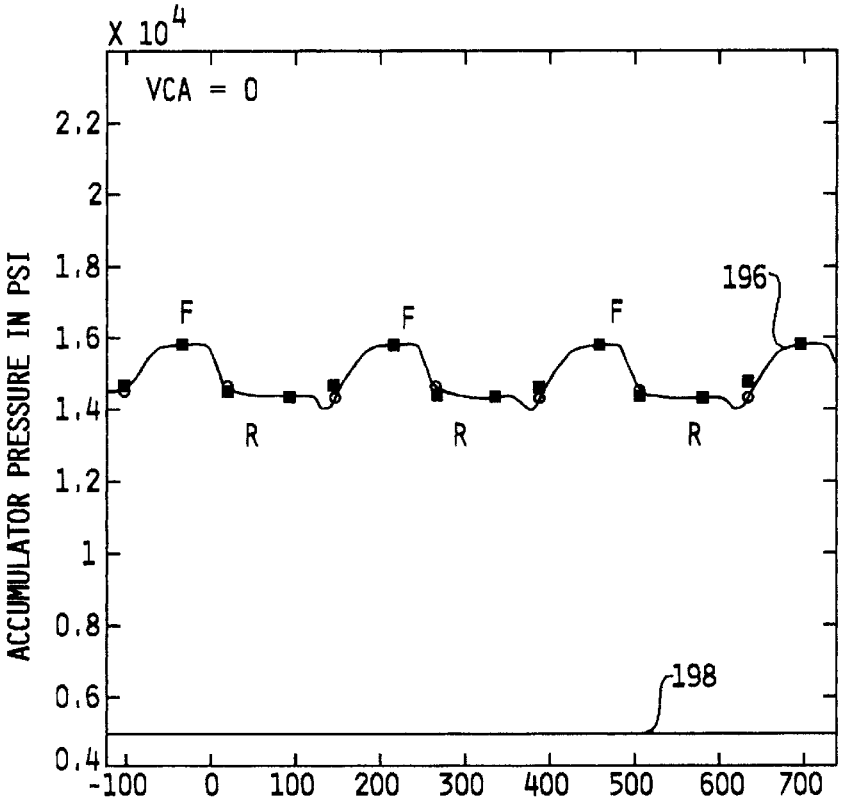
FIG. 8 is a plot of a pressure waveform associated with the accumulator of FIG. 1 illustrating a fuel pump injector control valve blow shut failure condition.

Referring now to FIG. 8, an example accumulator pressure waveform 196 is shown in contrast to a reference pressure value 198, wherein waveform 196 results from a fuel pump control valve blow shut failure condition associated with the front (first) pump element 24*b*. With respect to waveform 196 and for the front pump element 24*b*, $VCA_{f1}=0$, $VCA_{f2}=0$ and $VCA_{f3}=0$, while $\Delta Ap_{f1}=1201$ psi, $\Delta Ap_{f2}=1201$ psi and $\Delta Ap_{f3}=1201$ psi. In contrast, the accumulator pressure waveform for a normally operating fuel system 10 in response to zero commanded VCA should look similar to waveform 150 illustrated in FIG. 6. With respect to waveform 150 and for the front pump element 24*b*, $VCA_{f1}=0$, $VCA_{f2}=0$ and $VCA_{f3}=0$, while $\Delta Ap_{f1}=87.8$ psi, $\Delta Ap_{f2}=0$ psi and $\Delta Ap_{f3}=0$ psi.

Another example of a fuel system fault or failure condition that is diagnosable in accordance with the present invention is a pump element (24*b* or 24*c*) failure. If one of the pumping elements 24*b* or 24*c* fails (e.g. solenoid failure, seized pump plunger, etc.), the result of which is an inoperative pump, the control computer 58 is operable to detect accumulator pressure changes due to the different pumps and determine if one of the pumps has failed. In normal pumping operations, the rise in accumulator pressure due to consecutive front and rear pumping events is approximately equal. When a pumping element 24*b* or 24*c* fails, the rise in accumulator pressure due to that pump is negligible, while the operable pumping element pumps harder to compensate for the failed pump element. The control computer 58 is accordingly operable to determine an average rise in accumulator pressure due to each pumping element, determine a difference therebetween, and compare this difference with a threshold value.

Figure 9A:
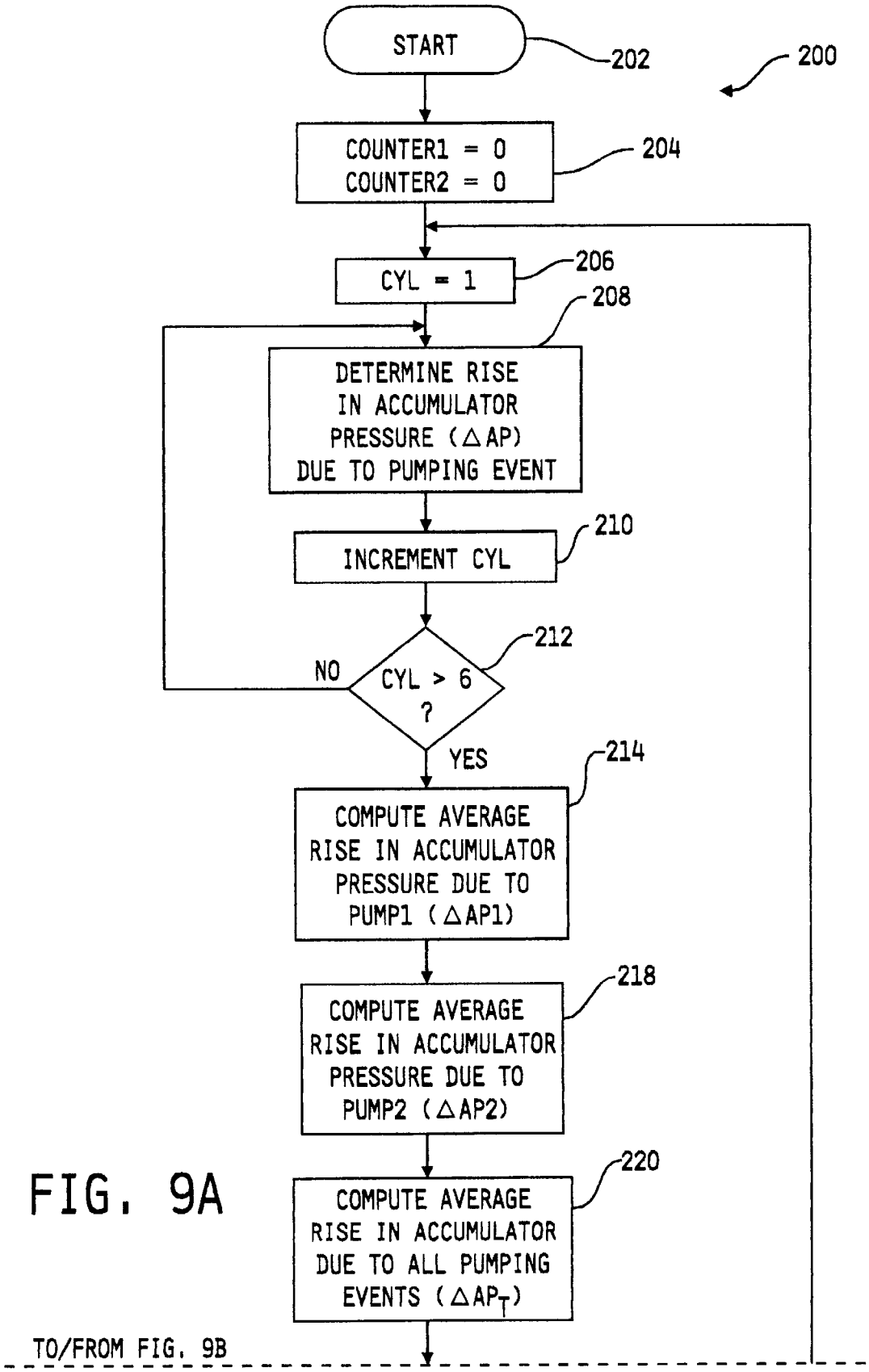
FIG. 9 is composed of FIGS. 9A and 9B and is a flowchart illustrating one preferred embodiment of a software algorithm for diagnosing the waveform of FIG. 4 for a failed fuel pump condition.
Figure 9B:
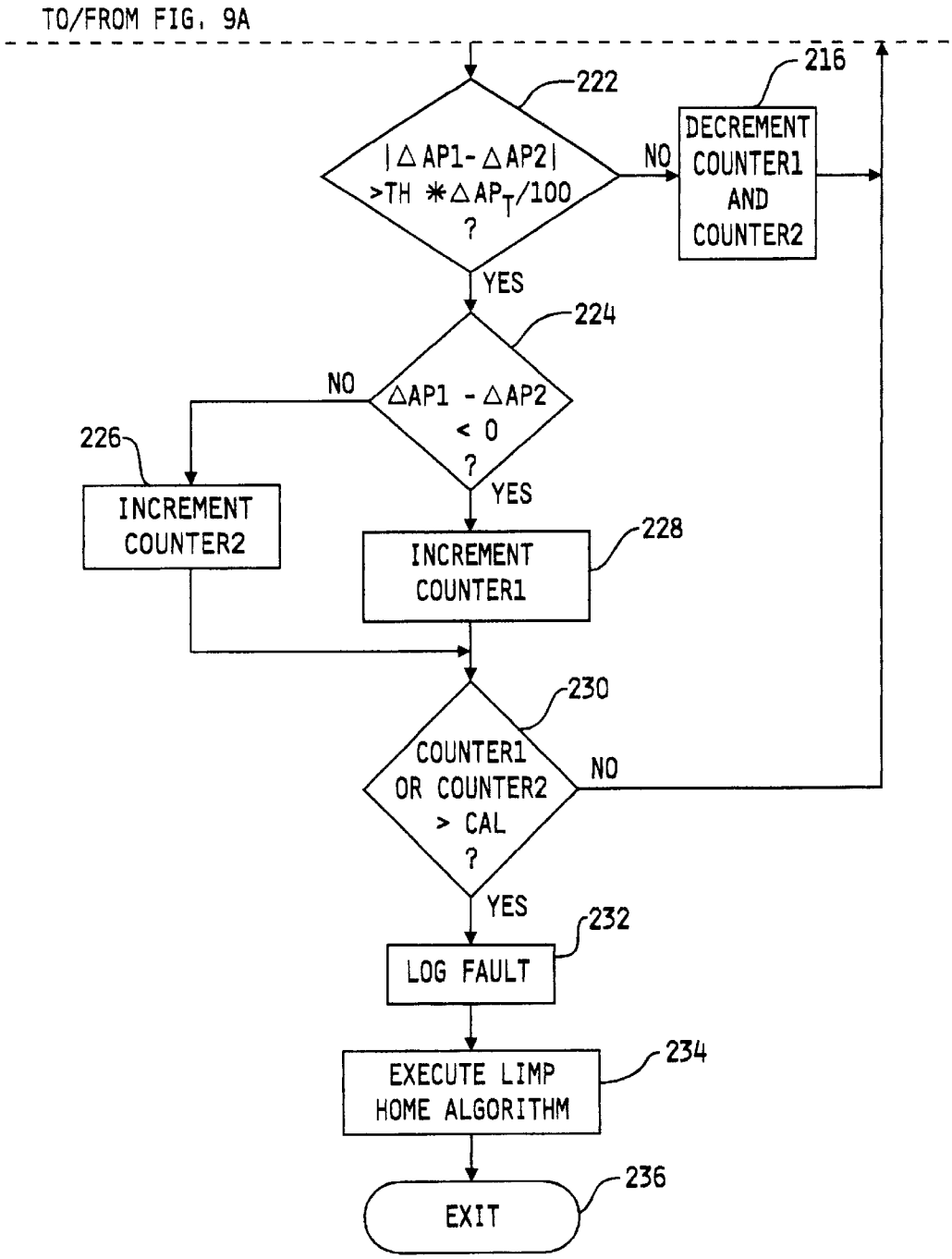

Referring to FIG. 9 which is composed of FIGS. 9A and 9B, one embodiment of a software algorithm 200 for diagnosing fuel system 10 for pump element failures is shown. Control computer 58 preferably has algorithm 200 stored therein and is operable to execute algorithm 200 many times per second as is known in the art. The algorithm begins at step 202 and at step 204, control computer 58 presets first and second error counters to an arbitrary value; zero in this case. Thereafter at step 206, control computer 58 sets a loop counter, cyl, wherein cyl is equal to the number of pumping/injection events (here six), to an arbitrary value; one in this case. Thereafter at step 208, control computer 58 determines a rise in accumulator pressure ΔAP due to activation of one of the pump elements 24*b* or 24*c*. For the purposes of algorithm 200, the reference pressure for each execution of step 204 preferably remains constant. Control computer 58 stores the ΔAP corresponding to current pumping/injection event at step 208, increments cyl at step 210 and thereafter tests cyl to determine whether all pumping/injection events have been processed. In the present example, six such pumping/injection events occur so that control computer stores six such ΔAP values. At step 212, control computer 58 thus tests cyl against the value six, and if less than or equal to six, algorithm execution loops back to step 208. If, on the other hand, control computer determines at step 212 that cyl is greater than six, algorithm execution continues at step 214.

At step 214, control computer 58 determines an average rise in accumulator pressure $\Delta AP_1$ due to the first (front) pump element 24*b*. Preferably, control computer 58 determines $\Delta AP_1$ as an algebraic average of all ΔAP values attributable to the first pump element 24*b*, although the present invention contemplates determining $\Delta AP_1$ in accordance with other averaging techniques such as root mean square or median computations, or other more complicated techniques. Additionally, the present invention contemplates computing $\Delta AP_1$ based on less than all ΔAP values attributable to the first pump element 24*b*. In any case, algorithm execution continues from step 214 at step 218.

At step 218, control computer 58 determines an average rise in accumulator pressure $\Delta AP_2$ due to the second (rear) pump element 24*c*. Preferably, control computer 58 determines $\Delta AP_2$ as an algebraic average of all ΔAP values attributable to the second pump element 24*c*, although the present invention contemplates determining $\Delta AP_2$ in accordance with other averaging techniques such as root mean square or median computations, or other more complicated techniques. Additionally, the present invention contemplates computing $\Delta AP_2$ based on less than all $\Delta AP$ values attributable to the first pump element 24*c*. In any case, algorithm execution continues from step 218 at step 220.

At step 220, control computer 58 determines an average rise in accumulator pressure $\Delta AP_T$ due to both the first (front) pump element 24*b* and second (rear) pump element 24*c*. Preferably, control computer 58 determines $\Delta AP_T$ as an algebraic average of all $\Delta AP$ values attributable to the first and second pump elements 24*b* and 24*c*, although the present invention contemplates determining $\Delta AP_T$ in accordance with other averaging techniques such as root mean square or median computations, or other more complicated techniques. Additionally, the present invention contemplates computing $\Delta AP_T$ based on less than all $\Delta AP$ values attributable to the first and second pump elements 24*b* 24*c*, although preferably the same number of $\Delta AP$ values attributable to the first and second pump elements 24*b* and 24*c* are used in the computation. In any case, algorithm execution continues from step 220 at step 222.

At step 222, control computer 58 compares $\Delta AP_1$ and $\Delta AP_2$, and if a difference therebetween is less than or equal to a pressure change limit, algorithm execution continues at step 216 where both error counters counter1 and counter2 are decremented (preferably not less than zero), and algorithm execution thereafter loops back to step 206. If, at step 222, the difference between $\Delta AP_1$ and $\Delta AP_2$ is greater than a pressure change limit, algorithm execution continues at step 224. In one preferred embodiment, the pressure change limit used in step 222 is equal to a threshold value TH times $\Delta AP_T/100$, although other pressure change limit values are contemplated. The threshold value TH, in one preferred embodiment, is 100% although other values for TH are contemplated.

At step 224, computer 58 again compares $\Delta AP_1$ and $\Delta AP_2$ to determine which of the pump elements 24*b* or 24*c* have failed. If the difference between $\Delta AP_1$ and $\Delta AP_2$ is greater than zero, the second (rear) pump element 24*c* has failed and algorithm execution continues at step 226 where the second error counter is incremented. If, at step 224, the difference between $\Delta AP_1$ and $\Delta AP_2$ is less than zero, the first (front) pump element 24*b* has failed and algorithm execution continues at step 228 where the first error counter is incremented. Algorithm execution continues from either of steps 226 or 228 at step 230.

At step 230, control computer 58 determines whether either of the error counters counter1 or counter2 are greater than a predefined (and preferably calibratable) count value. If neither error counter is greater than the predefined count value, algorithm execution loops back to step 206, If, at step 230, control computer 58 determines that either error counter is greater than the predefined count value, algorithm execution continues at step 232 where control computer 58 logs a corresponding fault code. Thereafter at step 234, control computer 58 executes a limp home fueling algorithm directed at pump related failures. Preferably, the limp home algorithm is directed to providing at least minimum fueling to sustain engine operation so that the vehicle may be driven out of danger and/or to a service/repair facility. One example of such a limp home algorithm is detailed in U.S. Pat. No. 5,937,826 entitled APPARATUS FOR CONTROLLING A FUEL SYSTEM OF AN INTERNAL COMBUSTION ENGINE and assigned to the assignee of the present invention, the contents of which have been incorporated herein by reference. Algorithm execution continues from step 234 at step 236 where algorithm execution is returned to its calling routine. Alternatively, step 234 may loop back to step 204 for continuous execution of algorithm 200.

Figure 10:
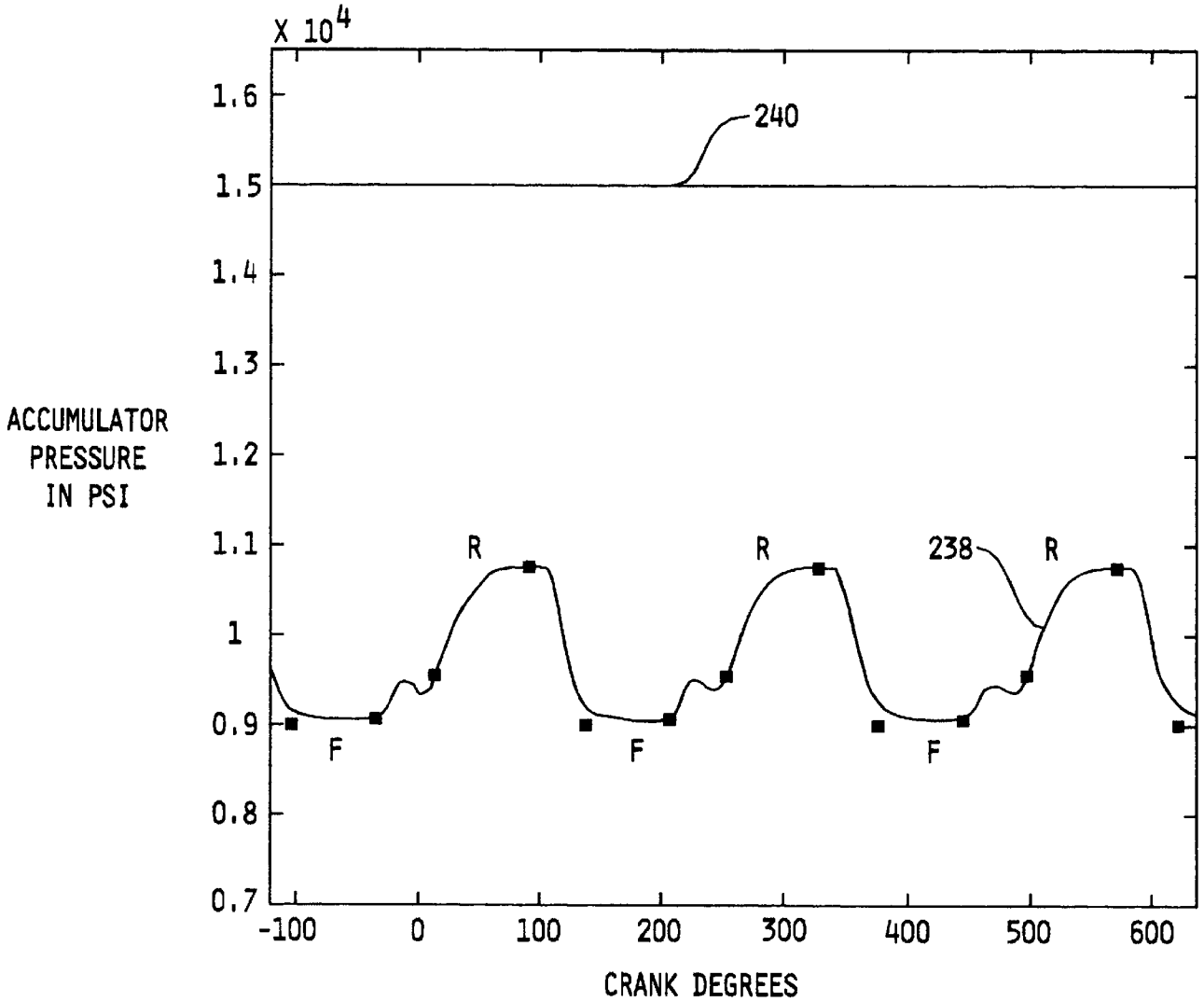
FIG. 10 is a plot of a pressure waveform associated with the accumulator of FIG. 1 illustrating a failed fuel pump condition.

Referring now to FIG. 10, an example accumulator pressure waveform 238 is shown in contrast to a reference pressure value 240, wherein waveform 234 results from a failed first (front) pump element 24*b*. With respect to waveform 238, $\Delta Ap_1$=78.0 psi, $\Delta Ap_2$=1044.7 psi and $\Delta AP_T$=561.3 psi. In contrast, the accumulator pressure waveform for a normally operating fuel system 10 in response to zero commanded VCA should look similar to waveform 110 illustrated in FIG. 4. With respect to waveform 110, $\Delta Ap_1$=1338.0 psi, $\Delta Ap_2$=1367.7.7 psi and $\Delta AP_T$=1352.8 psi.

In accordance another aspect of the present invention, control computer 58 is operable to monitor the pump command signal provided on signal path 78, and compare current values of this signal with expected pump command values stored in control computer 58, wherein the expected pump command values are based on engine operating conditions corresponding to current engine speed, current fuel command (FIG. 2) and current accumulator pressure. If the current pump command signal is outside of a specified range of the expected pump command value, control computer 58 logs a fault code therein and executes a limp home fueling algorithm directed at fuel pump-related failures. This aspect of the present invention is directed at diagnosing overpumping conditions associated with either fuel pump element 24*b* or 24*c*.

Figure 11:
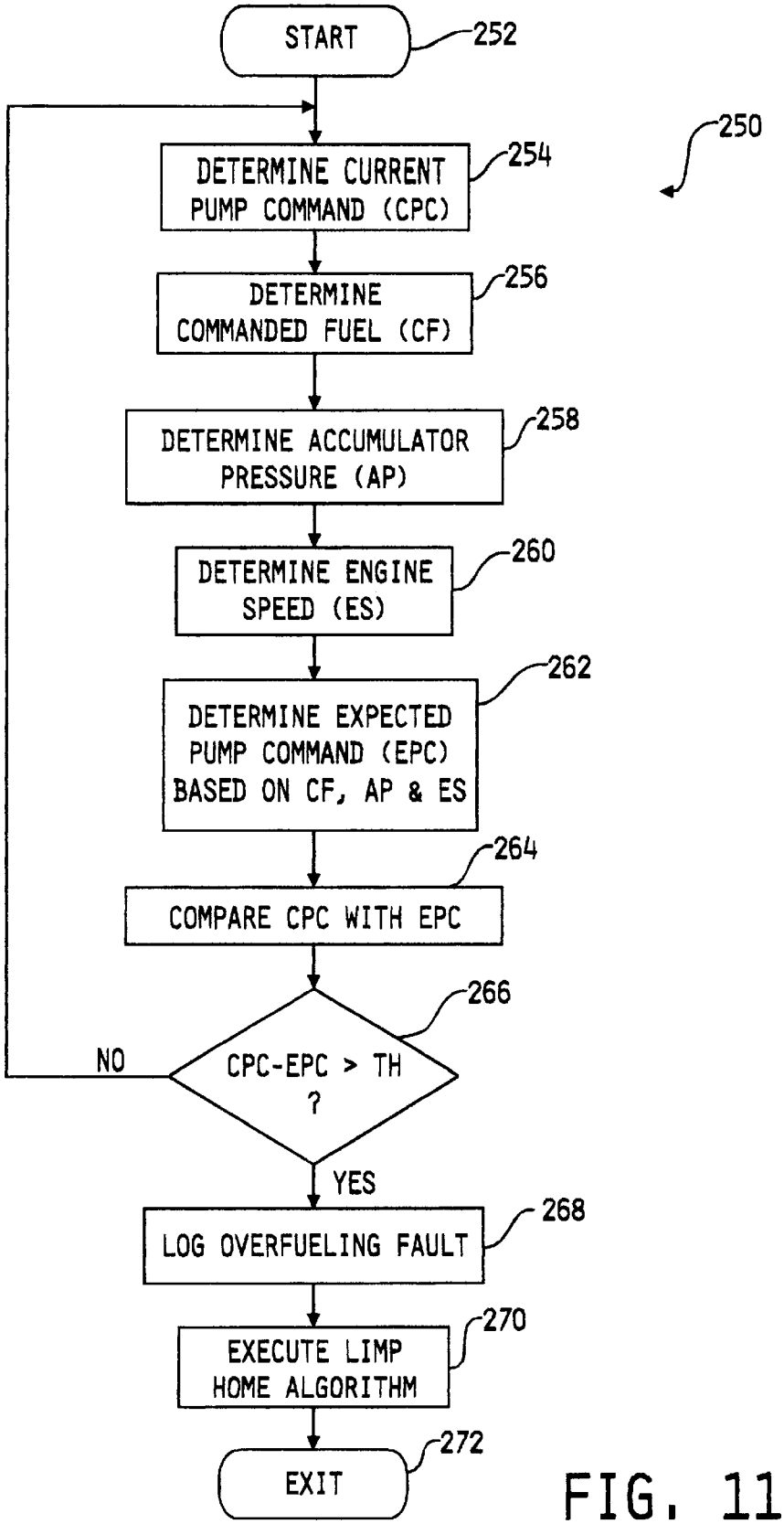
FIG. 11 is a flowchart illustrating one preferred embodiment of a software algorithm for diagnosing overpumping of fuel in the fuel system of FIG. 1.

Referring now to FIG. 11, one embodiment of a software algorithm 250 for diagnosing fuel system 10 for overpumping conditions attributable to either of the pump elements 24*b* and 24*c* is shown. Control computer 58 preferably has algorithm 250 stored therein and is operable to execute algorithm 250 many times per second as is known in the art. The algorithm begins at step 252 and at step 254, control computer 58 is operable to sample the current pump command signal provided on signal path 78, which preferably corresponds to determining a present VCA value (see FIG. 3). Thereafter at step 256, control computer 58 is operable to determine a current fuel command (CPC) value (see FIG. 2). Thereafter at step 258, control computer 58 is operable to determine a current accumulator pressure value, preferably by sensing the pressure signal on signal path 74. Thereafter at step 260, control computer 58 is operable to determine a current engine speed value, preferably by sensing the engine speed signal on signal path 70. Thereafter at step 262, control computer 58 is operable to determine the fuel temperature (FT) within accumulator 34 or conduits 36*a*, 36*b* or 40, preferably by sensing the combination fuel pressure and fuel temperature signal provided by sensor 72 on signal path 74 as discussed hereinabove. Thereafter at step 264, control computer 58 is operable to determine an expected pump command (EPC) value based on current values of the fuel command, accumulator pressure signal, engine speed signal and fuel temperature signal. It is to be understood, however, that the present invention contemplates determining the EPC value based on any one or more of the foregoing signals or values.

In one preferred embodiment, control computer 58 includes a number of look up tables stored therein, wherein each of the number of look up tables corresponds to a unique engine speed range and fuel temperature range, and wherein the number of look up tables together span a useful range of engine speeds and fuel temperatures. An example of a look up table for one such engine speed (ES) range $ES_1<ES<ES_2$ and fuel temperature range $FT_1<FT<FT_2$ is shown in FIG.

12. Referring to FIG. 12, each column of look up table 280 corresponds to an accumulator pressure (AP) value and each row corresponds to a fuel command (FC) value. The table 280 is filled in with expected pump command values based on a current engine speed range $ES_1<ES<ES_2$, a current fuel temperature range $FT_1<FT<FT_2$, a current accumulator pressure value (AP) and a current fuel command value (FC). The present invention contemplates alternately constructing table 280 with the rows and columns thereof defined by different ones of the preferred three variables. One example of such an alternate construction is providing a number of look up tables each having a different accumulator pressure range and fuel temperature range, wherein each column thereof corresponds to an engine speed value and each row corresponds to a fuel command (FC) value. Other combinations are also contemplated. In an alternate embodiment, control computer includes a number of three dimensional tables therein, wherein each of the number of look up tables corresponds to a unique engine speed range (or other operating range of one of the remaining parameters), and wherein the number of look up tables together span a useful range of engine speeds. The present invention also contemplates determining the EPC value based on a mathematical function of commanded fuel, accumulator pressure, engine speed and fuel temperature. Such a mathematical function could be continuous, piecewise continuous or non-continuous.

Referring again to FIG. 11, algorithm execution continues at step 266 where control computer 58 compares CPC with EPC, preferably by computing a difference therebetween. In a alternate embodiment of the present invention, a number of expected pump command waveforms may be stored within control computer 58, each corresponding to one or more specific engine operating conditions, wherein control computer is operable at step 264 to retrieve a particular one of the waveforms based on current operating conditions, and is subsequently operable at step 266 to conduct a comparison therebetween by performing a template analysis or similar known signal comparison technique. In any event, algorithm execution continues from step 266 at step 268 where control computer loops back up to step 254 if a difference between CPC and EPC is less than or equal to a threshold value TH. If, at step 268, control computer 58 determines that the difference between CPC and EPC is greater than TH, algorithm execution continues at step 270 where control computer 58 logs an overfueling fault code therein. Thereafter at step 272, control computer 58 executes a limp home fueling algorithm directed at fuel pump related failures. Preferably, the limp home algorithm is directed to providing at least minimum fueling to sustain engine operation so that the vehicle may be driven out of danger and/or to a service/repair facility. One example of such a limp home algorithm is detailed in U.S. Pat. No. 5,937,826 entitled APPARATUS FOR CONTROLLING A FUEL SYSTEM OF AN INTERNAL COMBUSTION ENGINE and assigned to the assignee of the present invention, the contents of which have been incorporated herein by reference. Algorithm execution continues from step 272 at step 274 where algorithm execution is returned to its calling routine. Alternatively, step 272 may loop back to step 254 for continuous execution of algorithm 250.

While the invention has been illustrated and described in detail in the foregoing drawings and description, the same is to be considered as illustrative and not restrictive in character, it being understood that only one preferred embodiment thereof has been shown and described and that all changes and modifications that come within the spirit of the invention are desired to be protected.

What is claimed is:

1. Apparatus for diagnosing a fuel system of an internal combustion engine, comprising:

a first fuel pump responsive to a pump command signal for supplying high pressure fuel from a lower pressure fuel source;

an accumulator receiving said high pressure fuel from said first fuel pump;

a valve responsive to a valve control signal for drawing high pressure fuel from said accumulator;

means for sensing fuel pressure within said accumulator and producing a pressure signal corresponding thereto, said pressure signal having peak values corresponding to peak pressures of fuel supplied thereto by said first fuel pump and lower valley values corresponding to valley pressures of fuel within said accumulator resulting from fuel drawn therefrom; and a control computer sampling a number of first pressure values each near a separate one of said peak values and a number of second pressure values each near a separate one of said valley values of said pressure signal and determining an average pressure value based thereon, said control computer comparing each of said number of first and second pressure values to said average pressure value and incrementing an error counter if at least one of said number of first and second pressure values are outside of a threshold range of said average pressure value.

2. The apparatus of claim 1 wherein said control computer is operable to decrement said error counter if at least some of said number of first and second pressure values are within said threshold range of said average pressure value.

3. The apparatus of claim 2 wherein said control computer is operable to log a fault code if said error counter exceeds a predefined count value.

4. The apparatus of claim 2 wherein said control computer is operable to execute a limp home fueling algorithm if said error counter exceeds a predefined count value.

5. The apparatus of claim 1 further including a second fuel pump responsive to said pump command signal for supplying high pressure fuel to said accumulator from said lower pressure fuel source, said pressure signal having additional peak values corresponding to peak pressures of fuel supplied thereto by said second fuel pump and additional lower valley values corresponding to valley pressures of fuel within said accumulator resulting from fuel drawn therefrom.

6. The apparatus of claim 1 wherein said control computer is operable to produce said pump command signal and said valve control signal, said pump command signal based on a target peak pressure value corresponding to a desired peak fuel pressure within said accumulator.

7. A method of diagnosing a fuel system of an internal combustion engine, comprising the steps of:

activating a first fuel pump to supply fuel from a fuel source to an accumulator based on a target fuel pressure value;

measuring a first pressure value within said accumulator near an actual peak pressure value therein resulting from activation of said first fuel pump;

activating a control valve to draw pressurized fuel from said accumulator resulting from activation of said first fuel pump, said accumulator thereafter defining a valley fuel pressure therein;

measuring a second pressure value within said accumulator near said valley fuel pressure;

determining an average pressure value based on a number of said first and second pressure values;

comparing each of said number of first and second pressure values with said average pressure value; and incrementing an error counter if at least one of said number of first and second pressure values are outside of a threshold range of said average pressure value.

8. The method of claim 7 further including the step of decrementing said error counter if at least some of said number of first and second pressure values are within said threshold range of said average pressure value.

9. The method of claim 8 further including the step of logging a fault code if said error counter exceeds a predefined count value.

10. The method of claim 9 further including the step of executing a limp home fueling algorithm if said error counter exceeds said predefined count value.

11. The method of claim 7 further including the steps of:

activating a second fuel pump to supply fuel to said accumulator based on said target fuel pressure value;

measuring a third pressure value within said accumulator near an actual peak pressure value therein resulting from activation of said second fuel pump;

activating said control valve to draw pressurized fuel from said accumulator supplied resulting from activation of said second fuel pump, said accumulator thereafter defining another valley fuel pressure therein;

measuring a fourth pressure value within said accumulator near said another valley fuel pressure;

and wherein said determining step includes determining said average pressure value additionally based on said number of said third and fourth pressure values;

and wherein said comparing step includes additionally comparing each of said number of third and fourth pressure values with said average pressure value;

and wherein said incrementing step additionally includes incrementing said error counter is at least one of said third and fourth pressure values are outside of said threshold range of said average pressure value.

12. The method of claim 11 further including the step of decrementing said error counter if at least some of said number of first, second, third and fourth pressure values are within said threshold range of said average pressure value.

13. The method of claim 12 further including the step of logging a fault code if said error counter exceeds a predefined count value.

14. The method of claim 13 further including the step of executing a limp home fueling algorithm if said error counter exceeds said predefined count value.

15. Apparatus for diagnosing a fuel system of an internal combustion engine, comprising:

a first fuel pump responsive to first pump command signals for supplying high pressure fuel from a lower pressure fuel source;

an accumulator receiving said high pressure fuel from said first fuel pump;

means for sensing fuel pressure within said accumulator and producing a pressure signal corresponding thereto; and a control computer receiving said pressure signal and producing said first pump control signals, said control computer producing a number of first pump command signals corresponding to zero commanded fueling and monitoring first corresponding changes in said pressure signal, said control computer incrementing an error counter if at least one of said first corresponding changes in said pressure signal exceeds a predefined pressure change threshold.

16. The apparatus of claim 15 wherein said control computer is operable to decrement said error counter if at least some of said first corresponding changes in said pressure signal are less than said predefined pressure change threshold.

17. The apparatus of claim 16 wherein said control computer is operable to log a fault code if said error counter exceeds a predefined count value.

18. The apparatus of claim 16 wherein said control computer is operable to execute a limp home fueling algorithm if said error counter exceeds a predefined count value.

19. The apparatus of claim 15 further including a second fuel pump responsive to second pump command signals for supplying high pressure fuel from said lower pressure fuel source to said accumulator;

and wherein said control computer is operable to produce a number of second pump command signals corresponding to zero commanded fueling and monitoring second corresponding changes in said pressure signal, said control computer incrementing said error counter if at least one said second corresponding changes in said pressure signal exceeds said predefined pressure change threshold.

20. The apparatus of claim 19 wherein said control computer is operable to decrement said error counter if at least some of said second corresponding changes in said pressure signal are less than said predefined pressure change threshold.

21. The apparatus of claim 20 wherein said control computer is operable to log a fault code if said error counter exceeds a predefined count value.

22. The apparatus of claim 21 wherein said control computer is operable to execute a limp home fueling algorithm if said error counter exceeds a predefined count value.

23. The apparatus of claim 19 further including:

a first pump control valve responsive to said first pump command signals for supplying first commanded fuel quantities to said first pump; and a second pump control valve responsive to said second pump command signals for supplying second commanded fuel quantities to said second pump;

and wherein said control computer is operable to provide said number of first and second pump command signals corresponding to zero commanded fuel quantities and monitoring corresponding changes in said pressure signal.

24. A method of diagnosing a fuel system of an internal combustion engine, comprising the steps of:

activating a first fuel pump to supply zero commanded fuel from a fuel source to an accumulator;

measuring a first corresponding change in pressure in said accumulator resulting from activation of said first fuel pump with zero commanded fuel;

repeating said activating and measuring steps a number of times;

comparing each of said number of first corresponding changes in pressure with a pressure change threshold; and incrementing an error counter if at least one of said number of first corresponding changes in pressure exceeds a pressure change threshold.

25. The method of claim 24 further including the step of decrementing said error counter if at least some of said number of first corresponding changes in pressure are less than said pressure change threshold.

26. The method of claim 25 further including the step of logging a fault code if said error counter exceeds a predefined count value.

27. The method of claim 26 further including the step of executing a limp home fueling algorithm if said error counter exceeds said predefined count value.

28. The method of claim 24 further including the steps of:

activating a second fuel pump to supply zero commanded fuel from said fuel source to said accumulator;

measuring a second corresponding change in pressure in said accumulator resulting from activation of said second fuel pump with zero commanded fuel;

repeating said activating a second fuel pump and measuring a second corresponding change steps a number of times;

comparing each of said number of second corresponding changes in pressure with said pressure change threshold; and incrementing said error counter if at least one of said number of second corresponding changes in pressure exceeds said pressure change threshold.

29. The method of claim 28 further including the step of decrementing said error counter if at least some of said number of second corresponding changes in pressure are less than said pressure change threshold.

30. The method of claim 29 further including the step of logging a fault code if said error counter exceeds a predefined count value.

31. The method of claim 30 further including the step of executing a limp home fueling algorithm if said error counter exceeds said predefined count value.

32. Apparatus for diagnosing a fuel system of an internal combustion engine, comprising:

a first fuel pump responsive to first pump command signals for supplying high pressure fuel from a lower pressure fuel source;

a second fuel pump responsive to second pump command signals for supplying high pressure fuel from said lower pressure fuel source;

an accumulator receiving said high pressure fuel from said first and second fuel pumps;

means for sensing fuel pressure within said accumulator and producing a pressure signal corresponding thereto; and a control computer producing a number of said first and second pump command signals and monitoring first and second corresponding changes in said pressure signal, said control computer determining first and second average pressure change values based on respective ones of said number of first and second corresponding changes in said pressure signal, said control computer incrementing an error counter if a difference between said first and second average pressure change values is one of greater than a first pressure change limit and less than a second pressure change limit.

33. The apparatus of claim 32 wherein said control computer is operable to decrement said error counter if said difference between said first and second average pressure change values is one of less than said first pressure change limit and greater than said second pressure change limit.

34. The apparatus of claim 33 wherein said control computer is operable to log a fault if said error counter exceeds a predefined count value.

35. The apparatus of claim 33 wherein said control computer is operable to execute a limp home fueling algorithm if said error counter exceeds a predefined count value.

36. The apparatus of claim 36 wherein said control computer is operable to determine a third average pressure change value based on said number of first and second corresponding changes in said pressure signal, wherein said first and second pressure change limits are each functions of said third average pressure change value and a threshold value.

37. A method of diagnosing a fuel system of an internal combustion engine, comprising the steps of:

activating a first fuel pump to supply fuel to an accumulator based on a target fuel pressure value;

activating a second fuel pump to supply fuel to said accumulator based on said target fuel pressure value;

determining a first pressure change value corresponding to a change in fuel pressure within said accumulator resulting from activation of said first pump;

determining a second pressure change value corresponding to a change in fuel pressure within said accumulator resulting from activation of said second pump;

repeating said activation steps and said determining steps a number of times;

computing a first average pressure change value as an average of said number of first pressure change values;

computing a second average pressure change value as an average of said number of second pressure change values; and incrementing an error counter if a difference between said first and second average pressure change values is one of greater than a first pressure change limit and less than a second pressure change limit.

38. The method of claim 37 further including the step of decrementing said error counter if a difference between said first and second average pressure change values is one of less than said first pressure change limit and greater than said second pressure change limit.

39. The method of claim 38 further including the step of logging a fault code if said error counter exceeds a predefined count value.

40. The method of claim 39 further including the step of executing a limp home fueling algorithm if said error counter exceeds said predefined count value.

41. The method of claim 37 further including the step of computing a third average pressure change value as an average of said number of first pressure change values and said number of second pressure change values;

and wherein said first and second pressure change limits are each functions of said third average pressure change value and a threshold value.

* * * * *